US006450802B1

(12) United States Patent
Steck

(10) Patent No.: US 6,450,802 B1
(45) Date of Patent: Sep. 17, 2002

(54) DECORATIVE CANDLES AND METHOD OF MAKING THEM

(76) Inventor: Robb Steck, 1461 Woodside Rd., Redwood City, CA (US) 94061

( * ) Notice: Subject to any disclaimer, the term of this patent is extended or adjusted under 35 U.S.C. 154(b) by 22 days.

(21) Appl. No.: 09/729,181

(22) Filed: Dec. 5, 2000

(51) Int. Cl.[7] ..... C11C 5/00
(52) U.S. Cl. ..... 431/288; 44/275
(58) Field of Search ..... 431/126, 288, 431/289; 44/275

(56) References Cited

U.S. PATENT DOCUMENTS 3,974,014 A 8/1976 Meisner et al.
4,225,552 A 9/1980 Chang
5,597,300 A 1/1997 Wohl et al.

FOREIGN PATENT DOCUMENTS

JP 8-197899 A * 8/1996
WO WO-87/03004 A1 * 5/1987 ..... 44/275

OTHER PUBLICATIONS

Innes, M., *The Book of Candles*, 1991, DK Publishing, pp. 68 and 69.*
Heller, B., *Candlemaking, A Step–by–Step Guide*, 1972, Nash Publishing Corp., pp. 15–17.*

* cited by examiner

*Primary Examiner*—Sara Clarke
(74) *Attorney, Agent, or Firm*—Millen, White, Zelano & Branigan, P.C.

(57) ABSTRACT

A method of applying an image to the surface of a wax candle is described, comprising applying the image to a film which is removably attached to a transfer material, wherein the film is a flexible, shape-conforming material which does not exhibit structural rigidity, and applying the film to the surface of the candle. The method can further comprise submerging the candle and applied film into molten wax, e.g. having a melting temperature which is about the same as or lower than the melting temperature of the candle to which the film is applied. Candles made by the method of the invention are also described.

11 Claims, 1 Drawing Sheet

DECORATIVE CANDLES AND METHOD OF MAKING THEM

DESCRIPTION OF THE INVENTION

This invention relates, e.g., to decorative candles, e.g., bearing images, and a method of making them.

One embodiment is a method of applying an image to the surface of a wax candle, comprising applying the image to a film which is removably attached to a transfer material, wherein the film is a flexible, shape-conforming material which does not exhibit structural rigidity, and applying the film to the surface of the candle.

The above method can further comprise submerging the candle and applied film into molten wax, e.g. a wax having a melting temperature which is about the same as or lower than the melting temperature of the candle to which the film is applied.

Another embodiment of the invention is a method of applying an image to the surface of a wax candle, comprising submerging the candle into molten wax, e.g. having a melting temperature which is the same as or lower than the melting temperature of the candle, the foregoing candle having applied thereto a film bearing an image, wherein the film is a flexible, shape-conforming material which does not exhibit structural rigidity.

The method of the invention comprises applying an image or graphic to the surface of a paraffin-based wax object, preferably a candle. The following discussion is directed primarily to candles; however, one of skill in the art will recognize that any wax object can be decorated by the method of the invention (e.g., a hollow wax shell or a solid wax object without a wick). A candle of the invention (sometimes referred to herein as a central core, wax core, or core) can have any desired size or shape. For example, the size can range from, e.g., a tiny, thimble sized object to a very large object, e.g., an elongated cylinder having a diameter of about 8 inches and a height of about 24 inches or more. The shape can be, e.g., square, polyhedral, trapezoidal, round, with or without a flattened bottom, cylindrical, irregular, or the like, preferably an elongated cylinder.

A candle of the invention is preferably solid wax, having a wick which protrudes from the upper surface of the candle. The composition and placement of such wicks are conventional. The candle can be of any paraffin wax based composition, and typically has a melting point of about 125° F. to about 150° F., preferably about 140° F. Optionally, the candle core can contain conventional components such as, e.g., oil and/or stearic acid, scents or aromas, or other agents known to one of skill in this art to enhance aesthetic and/or functional properties of the candle. In one embodiment, the candle core comprises about 89% paraffin, about 10% stearic acid, about 0.02% anti-oxidant, about 0.06% UV absorber and about 0.02% polyethylene. The core can be colorless (clear, translucent), or it can be colored (tinted) by conventional dyes or pigments. It can be of any color of interest, and/or can comprise a pattern, e.g., geometric designs, swirls of color, random arrangements of colors, helical designs, vertical or horizontal bands of color such as stripes, etc., or combinations of such solid hues and/or patterns.

The method of the invention can be used to apply any image or graphic of interest to a candle. The image or graphic can comprise text or designs, e.g., representational, abstract, geometric etc. designs, photographic images, or the like, or combinations thereof. In a preferred embodiment, the design is a gravure (e.g., photogravure) or lithographically applied inked halftone and/or shaded design.

The image is applied to a film (decal, decalomania, applique, covercoat) which is preferably removably attached to a transfer material. A film according to the invention is a flexible, shape-conforming material which does not exhibit structural rigidity. By not exhibiting "structural rigidity" is meant herein that the film, after having been applied to the surface of a candle, does not remain free-standing (structurally distinct, self-supporting) as the candle burns but, rather, is consumed and remains substantially flush with the top surface of the candle. An advantage of a film having this property is that, because the film does not form a freestanding structure which can burn separately as a secondary wick, the film does not ignite or "torch" as the candle burns. Furthermore, because in a candle having such a film on its surface, the film is not brought into contact with the burning wick, the film also cannot ignite or "torch" as a result of such contact. It can be advantageous if the film exhibits a degree of flexibility, elasticity and/or stretchiness so that it can be manipulated as it is applied to the candle in such a way that it completely covers the side surface(s) of the candle.

The film can be of any suitable material, e.g., a polymer or resin such as a conventional decal or decalomania material, provided that it is compatible with paraffin and retains the requisite properties (e.g., does not exhibit structural rigidity as the candle burns). By "compatible with paraffin" is meant herein that it adheres to paraffin in the absence of other binding agents. The film material can be, for example, a material (e.g., a thixotropic agent), of any suitable composition, which can be applied in liquid form to a transfer material and which can solidify to form a film of the invention. In a preferred embodiment, the solidified film has a thickness of less than about 300 $\mu$m, preferably less than about 200 $\mu$m, more preferably about 185±15 $\mu$m, and most preferably about 187±5 $\mu$m.

Exemplary films which have been shown to be operable in the invention are highly conventional, e.g., Meta 2000, 406/thix yellow, etc., and other comparable film forming material well known in the films field. Meta 2000, e.g., is available, e.g., from Hoffmann & Engelmann Aktiengesellschaft, Talstrasse 288, 6730 Neustadt/Weinstrasse, Germany. Meta 2000 is typically processed at a temperature of about 20–21° C. and 55–62% relative humidity; and, in its solid form, has a base weight, coated, of about 170±5 G/M$^2$; a thickness/caliper of about 187±5 $\mu$m; a gum deposit of about 11±5 G/M$^2$; a release time of about 45–60 seconds at 20° C.; and a surface with no scratches, blisters, coating skips or surface contamination that can affect printing.

A film of the invention is preferably clear (translucent), so that when it is applied to the surface of a candle, only the image thereupon remains visible and the film, itself, seems to "disappear." However, a tinted film can also be used.

Any suitable transfer material (backing), i.e., a material which provides support for a film and to which a film can be removably attached, and which itself can be made to be flexible (e.g., by treatment with liquid) and shape conforming can be used, e.g., plastic, fabric, paper, etc. A preferred transfer material is paper, having any suitable thickness, e.g., about 10 mil. If desired, an agent which facilitates the release of the transfer material from the film can be interposed between them. In a preferred embodiment, the film is released from the transfer material by a brief soaking in water. Appropriate water soluble release agents are well-known and conventional and include, e.g., dextrine or various cellulose derivatives, such a carboxymethyl cellulose, cellulose, hydroxypropyl cellulose, sodium carboxymethyl cellulose, or the like. Such water releasable materials are sometimes referred to as "water-mount," "water slide-off" or "water slide" material, e.g., paper, decal or decalomania.

A film can be applied to a transfer material by any of a variety of routine, conventional procedures. In a preferred embodiment, the film material, in the form of a liquid, is screen-printed onto the transfer material using a conventional screen printing technique, and is allowed to dry (solidify) at room temperature for an empirically determinable, optimal period of time, e.g., for about 24 hours, thereby forming a solid film having the properties described above.

An image or graphic can be introduced onto or into a film either directly or indirectly. Direct methods include, e.g., applying (e.g., printing) an image directly onto the exposed surface of a film which is attached to a transfer material. In one indirect method (a preferred embodiment), the image is first applied (e.g., printed) with ink onto a transfer material; then the film material in liquid form is spread (e.g., screen printed) onto the transfer material and, as it dries/hardens/solidifies to a solid film, the ink which is printed onto the transfer material binds to and/or becomes incorporated into or onto the film. Preferably, the transfer material (e.g., paper) is coated with a minimal amount of an agent (e.g., a lubricant such as oil) effective to inhibit ink from adhering to its surface, thereby enhancing the transfer of the image to the film.

Many conventional methods can be used to apply an image to a film or a transfer material, including, e.g., silk screening, air brushing, painting or printing (e.g., screen-printing, letterpress printing, offset printing, gravure or (offset) lithographic printing). In one embodiment, printing is performed using droplets of ink from nozzles being projected onto a surface to form a print, e.g., ink-jet printing. In a preferred embodiment, an image is printed by an offset printing technique, e.g., using a sheet fed printing press, preferably four-color (CMYK; cyan, magenta, yellow, black) offset printing. In a most preferred method, the design, e.g., a photographic image, a representational or non-representational (e.g., abstract) design, or a physical object of interest such as, e.g., a leaf or flower, is digitally scanned into a computer (e.g., scanned onto a diskette and modified in a computer as desired, for example to incorporate color(s)), and is then printed onto a transfer material, all of which methods are conventional.

Inks or other coloring materials which can be utilized in the method are conventional and are well-known in the art. They can be of any color or shade which can produce a decorative effect, can be of any suitable composition, and, preferably, are compatible with a wax surface (e.g., bond well with it, without smearing). A desirable property of the ink is that the solvent in which the ink pigment is dissolved is incapable of significantly solubilizing the wax surface of the candle to which it is applied, and/or with which it is coated, thereby reducing or eliminating smearing of the design. In one embodiment, the ink lacks a significant wax/paraffin component. Preferably, the ink has a kindling point which is less than the temperature at which the candle burns. An ink which has been demonstrated to be operable in the invention is a non-toxic ink of the Z-STYRENE: 6000 SERIES, available, e.g., from Winson Ink Co., Ltd., 43/39 Soi Walkumpeg, Bangkok 10150 Thailand. Such ink has, as its principal components, by weight per cent, 20–40% acrylated coploymer, 30–50% glycol ethers, 5–10% aromatic solvents, and 2–5% esters, and has a flashpoint of 130° F. Pigments of any desired color, preferably non-toxic ones, can be added to the ink base, following standard procedures.

A film bearing an image of interest can be released from a transfer material by conventional methods in the art. For example, in a preferred embodiment, a film attached to a water slide transfer material (e.g., paper) is immersed in water for an empirically determinable, relatively short, period of time, e.g., face down for about one minute, then face up for about one minute. In one embodiment, after such soaking, the decal plus transfer material is removed from the water; approximately one inch of the decal is removed from the backing and is positioned onto the candle by sliding the decal from the backing to the candle surface; and the decal is slid off the backing as it is rolled onto the candle.

The released film can be applied, using appropriate, conventional, methods, to any desired portion of a candle. In a preferred embodiment, the film is wrapped around the sides of a candle body, in close conforming relationship thereto; aligned to the top and bottom of the candle; and the sides are aligned so that the ends meet in a flush orientation, or slightly overlap each other, thereby substantially or completely covering the surface of the candle side(s). The design image can either face the candle body or face away from it. Of course, the film need not cover the surface of the candle completely and, e.g., it can contact the candle on as little as only a small proportion of its surface, e.g., a patch, a vertical or horizontal stripe, a helix, etc.

A film can be adhered to a candle by any suitable method. For example, one or more manual processes can be employed. In one embodiment, employing manual steps, the film is applied (e.g., wrapped around) the vertical surface of a candle by hand; and air and/or water bubbles are removed by pressing with a foam rubber squeegie. The candle is left to dry at room temperature for an empirically determinable suitable period of time (e.g., from about 30 minutes to about 48 hours), during which the film adheres to the candle. Residual bubbles can be removed by puncturing them, e.g. with a needle.

Alternatively, automated procedures, or combinations of manual and automated procedures, can be used. Automated procedures are conventional in the art and are described, e.g., in U.S. Pat. Nos. 3,974,014 and 5,908,525 and in references described therein.

After a film bearing an image has been applied to the surface of a candle and allowed to adhere to it, the candle can optionally be submerged into molten wax to provide a wax overcoat. Any suitable molten wax composition can be used, comprising, e.g., low melting point wax, high melting point wax (such as, e.g., beeswax), or a wax with a relatively high plastic content. In a preferred embodiment, the outer wax composition has a melting temperature which is about the same as or lower than that of the candle core. Preferably, the outer coating material has a melting temperature of less than about 140° F. In a preferred embodiment, the melting temperature of the dipping wax is substantially identical to that of the wax of the candle core.

Methods for applying such an outer layer or overdip are conventional. Generally, a paraffin wax based composition to be used for the outer layer is melted and cooled to an appropriate temperature. One of skill in the art can readily determine an appropriate temperature, which is low enough such that the film material does not melt or deform, yet high enough for the overdip wax to remain molten. For example, for Meta 2000, the optimal temperature of the dipping wax is equal to or less than about 90° F., e.g., about 85° F. The candle is submerged into a vessel (e.g., a vat) containing the molten wax, for an empirically determinable, short period of time, long enough to allow the entire candle to be covered by the overcoat, but not so long as to allow smearing of the applied image or release of the film. Typically, the dipping time is about one to two seconds.

Subsequent treatment procedures are conventional in the art. In a preferred embodiment, after the candle is dipped in molten wax, it is submerged into a cold water bath, which cools the overdipped wax shell and can impart a clear luster finish to the candle. Optionally, the candle can then be treated (e.g., placed on a heating pad) to melt away excess wax on the bottom surface of the candle and to level the candle base.

An outer coating of wax can protect a candle and image applied thereto against scuffing, smearing, smudging, scraping, scratching or other abrasions; provide a smooth, aesthetically pleasing surface (e.g., a glossy surface); and/or aid in the melting properties of the candle (e.g., permit even burning). The dipping wax can be clear (translucent) or the same or a different color than the candle core, and can comprise conventional components which impart special effects, such as luminescence, sparkles, glitter, moire patterns, surface texture, or the like.

Many interesting effects can be achieved, as will be evident to one of skill in the art. For example, if the dipping wax is translucent or is substantially identical in color to the wax of the candle core, the film will, in essence, "disappear" from view, and the image will appear to be imbedded completely in wax. In another embodiment, if the image comprises clear patches, e.g., is printed in black and "white," and the core of the candle and/or the dipping wax is colored, the uncolored portions of the image will take on the color of the core candle and/or dipping wax when the candle is illuminated. Of course, additional design elements can be added, using conventional methods known to those of skill in the art. For example, following the application of an image, but before dipping in overcoat wax, elements such as, e.g., wax flowers or other designs, can be applied to the surface of a candle.

The invention also comprises candles made by the method disclosed herein, e.g., a candle comprising an inner wax core, a polymer or resin film in contact with the inner wax core, and an outer layer of wax having a melting temperature which is about the same as or lower than that of the wax of the inner core; or comprising a layer of film which is a flexible, shape-conforming material which has a thickness of, e.g., less than about 200 $\mu$m; or comprising an inner wax core, a layer of film which is a flexible, shape-conforming material which does not exhibit structural rigidity, and an outer layer of wax, e.g. one having a melting temperature which is about the same as or lower than that of the wax of the inner core. In a preferred embodiment, the film in each of these types of candles bears an image or graphic.

BRIEF DESCRIPTION OF THE DRAWINGS

The FIGURE schematically depicts a candle of the invention. Numeral 1 is an inner wax core of the candle; numeral 2 is a film which has been applied to the surface of the candle; and numeral 3 is an outer layer of wax.

From the foregoing description, one skilled in the art can easily ascertain the essential characteristics of this invention, and without departing from the spirit and scope thereof, can make changes and modifications of the invention to adapt it to various usage and conditions.

Figure 1:
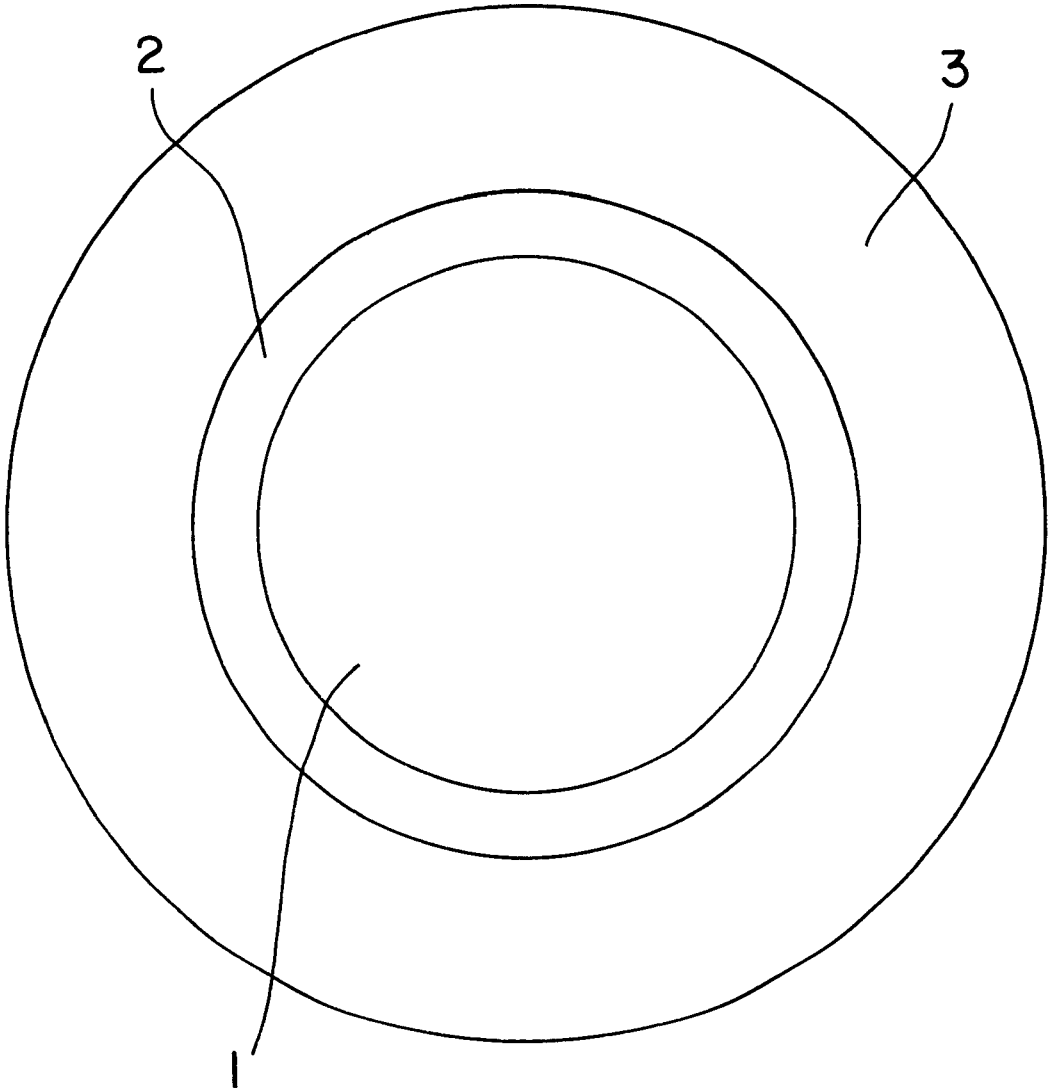

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The entire disclosure of all applications, patents and publications cited above are hereby incorporated by reference.

What is claimed is:

1. A candle comprising a) an inner wax core, b) a layer of film which is a flexible, shape-conforming material which does not exhibit structural rigidity, and which has applied thereto an image or graphic, and c) an outer layer of wax.

2. The candle of claim 1, wherein the outer layer of wax has a melting temperature which is about the same as or lower than that of the wax of the inner core.

3. The candle of claim 2, wherein the film has a thickness of less than about 200 $\mu$m.

4. The candle of claim 2, wherein the film has a thickness of 185±5 $\mu$m.

5. The candle of claim 2, wherein the film is META 2000.

6. The candle of claim 2, wherein the film does not torch when the candle burns.

7. The candle of claim 2, wherein the wax of the outer layer has a melting temperature of less than about 140° F.

8. The candle of claim 2, wherein the wax of the outer layer has a temperature equal to or less than about 90° F.

9. The candle of claim 2, further comprising an image or graphic applied to the film, wherein the image or graphic appears to be imbedded in wax.

10. A candle made by a method comprising a) applying an image to a film which is removably attached to a transfer material, wherein the film is a flexible, shape-conforming material which does not exhibit structural rigidity, b) applying the film to the surface of a candle, and c) submerging the candle and applied film into molten wax.

11. A candle made by the method of claim 10, wherein the molten wax has a melting temperature which is about the same as or lower than the melting temperature of the candle to which the film is applied.

* * * * *